US008292701B2

(12) United States Patent
Heng

(10) Patent No.: US 8,292,701 B2
(45) Date of Patent: Oct. 23, 2012

(54) BLADE SHARPENING ASSEMBLY

(75) Inventor: Wu Heng, Iishui Zhejiang (CN)

(73) Assignee: Taylor Brands, LLC, Kingsport, TN (US)

( * ) Notice: Subject to any disclaimer, the term of this patent is extended or adjusted under 35 U.S.C. 154(b) by 407 days.

(21) Appl. No.: 12/650,127

(22) Filed: Dec. 30, 2009

(65) Prior Publication Data

US 2011/0159791 A1 Jun. 30, 2011

(51) Int. Cl.
*B24B 19/00* (2006.01)

(52) U.S. Cl. ..... 451/371

(58) Field of Classification Search ..... 451/371
See application file for complete search history.

(56) References Cited

U.S. PATENT DOCUMENTS 905,331 A * 12/1908 Larson et al. ..... 451/175
961,010 A * 6/1910 Poitras et al. ..... 451/175
1,459,580 A * 6/1923 Downey et al. ..... 451/175
2,557,093 A * 6/1951 Garbarino ..... 76/82.2
4,216,627 A * 8/1980 Westrom ..... 451/175
4,404,873 A * 9/1983 Radish ..... 76/82
4,441,279 A * 4/1984 Storm et al. ..... 451/175
4,512,112 A * 4/1985 LeVine ..... 451/371
4,731,953 A * 3/1988 Owen ..... 451/163
5,185,958 A * 2/1993 Dale ..... 451/174
5,431,068 A * 7/1995 Alsch ..... 76/82
7,144,310 B2 * 12/2006 Longbrake ..... 451/349
7,867,062 B2 * 1/2011 Swartz ..... 451/175
2007/0249268 A1 * 10/2007 Swartz ..... 451/349

* cited by examiner

*Primary Examiner* — Maurina Rachuba
(74) *Attorney, Agent, or Firm* — Luedeka Neely Group, PC

(57) ABSTRACT

A blade sharpening assembly generally consisting of a base member; a clamping member disposed on the base member, cooperable therewith for releasably securing a blade thereon with a cutting edge thereof protruding therefrom; a guide post mountable on the base member; a carrier member mounted on the guide post, displaceable along a length thereof, including means for releasably securing the carrier member at selected positions along the length of the guide post; and a tool for sharpening a blade secured between the base and clamping members, including a handle section, an elongated section engageable with a support surface of the carrier member and a honing section engageable with a cutting edge of a blade secured between the base and clamping members when the elongated section engages the support surface of the carrier member.

18 Claims, 3 Drawing Sheets

BLADE SHARPENING ASSEMBLY

This invention relates to an improved blade sharpening assembly and more particularly to a device for retaining a blade to be sharpened and a tool cooperable with such a device for honing the edge of the retained blade.

BACKGROUND OF THE INVENTION

Conventional in the prior art is a type of blade sharpening arrangement generally consisting of a blade retaining device provided with honing tool guide means, and a honing tool provided with a rod portion cooperating with the guide means of the retaining device for running a honing surface of the tool along the cutting edge of the tool. Typically, the guide means comprises a fixed opening in an upright portion of the retaining device. Although such prior art devices have been satisfactory in use, they further have been found not to be entirely suitable in terms of effectiveness in use and precision in positioning and guiding the honing portion of the honing tool. Accordingly, it the principal object of the present invention to provide in assembly of the general type described which is functional in easily, effectively and precisely positioning the honing portion of the honing tool with selected portions of a retained blade being sharpened, and assuring the desired angle of engagement of the honing portion of the tool with the cutting edge of the blade. It further is an object of the present invention to provide such a honing tool in which the honing segment of the tool may be readily attached to and detached from the tool.

SUMMARY OF THE INVENTION

The principal objects of the invention are achieved by providing a blade sharpening assembly generally consisting of a base member; a clamping member disposed on the base member, cooperable therewith for releasably retaining a blade thereon with a cutting edge thereof protruding therefrom; a guide post mountable on the base member; a carrier member mounted on the guide post, displaceable along the length thereof, including means for releasably securing the carrier member at selected positions along the length of the guide post; and a tool for sharpening a blade retained between the base and clamping members, including a handle section, an elongated section engageable with a support surface of the carrier surface and a honing section engageable with a cutting edge of a blade retained between the base and clamping member when the elongated section engages the support surface of the carrier member. Preferably, the carrier member is provided with a member swivably connected to the carrier member, providing the support surface for the rod section of the honing tool.

DETAILED DESCRIPTION OF THE PREFERRED EMBODIMENTS OF THE INVENTION

Figure 1:
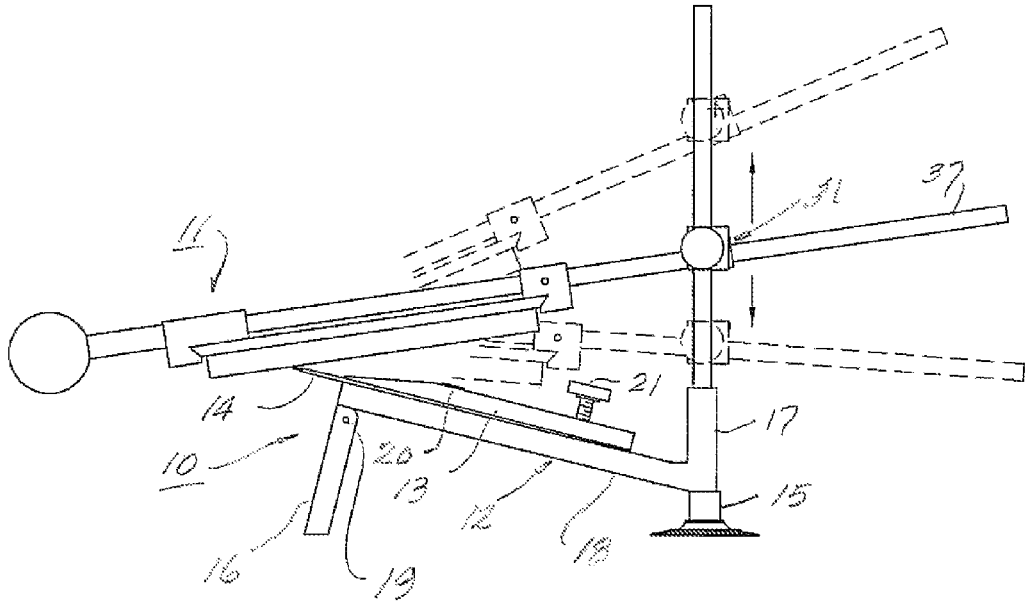
FIG. 1 is a side elevational view of a blade sharpening assembly embodying the present invention, illustrating alternate angular positions of the honing tool thereof in a vertical plane, in phantom lines.
Figure 2:
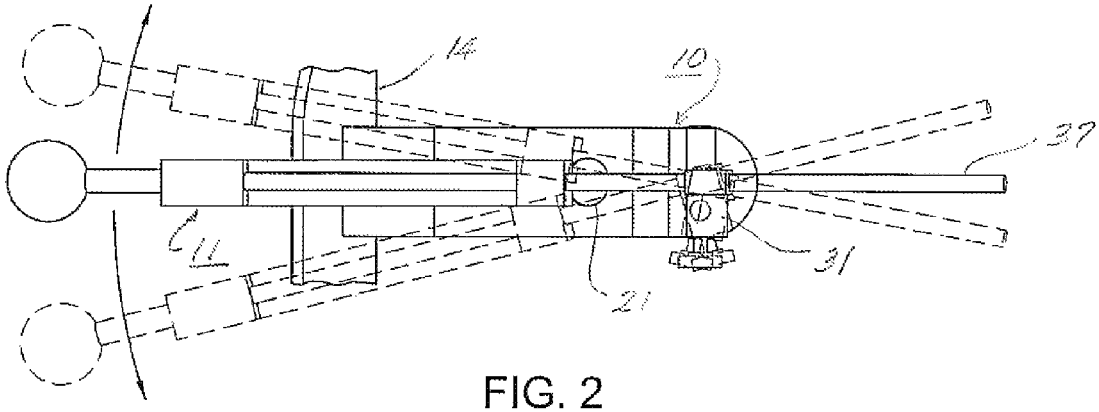
FIG. 2 is a top plan view of the assembly shown in FIG. 1 illustrating alternate angular positions of the honing tool in a horizontal plane, in phantom lines.

Referring to the drawings, there is illustrated a preferred embodiment of the invention consisting a blade retaining and honing tool positioning assembly 10 and a honing tool member 11 cooperable with assembly 10 for guiding the tool member relative to a blade retained on the assembly. Assembly 10 consists of a base member 12 cooperable with a clamping member 13, a rear support leg 15 and a front support leg 16. Base member 12 further consists of an upstanding section 17 disposed in substantially vertical alignment with rear support leg 15 and an elongated section 18 disposed at an angle relative to section 17. Front support leg 16 is pivotally connected as at 19 to the underside of elongated section 18 so that it may be disposed in an extended position as shown in FIG. 1 to support the free end of elongated section 18, and pivoted along the underside of the elongated section for storage purposes. Clamping member 13 has an elongated configuration and is disposed on the upper side of base section 18. It is secured to base section 18 by means of a screw 20 which extends through an opening in clamping member 13 and is threaded into a threaded opening in base section 18 to loosely secure the clamping member to base section 18, and functions as a fulcrum for angularly displacing the clamping member relative to base section 18. The clamping member further is provided with a screw 21 threaded through an opening in the clamping member and engaging the upper side of base section 18. It will be appreciated that by turning screw 21, the forward end of clamping member 13 will be caused to angularly displace relative to the forward end of base section 18 about the fulcrum provided by screw 20 to clamp blade 14 between the forward ends of base section 18 and clamping member 13.

Figure 6:
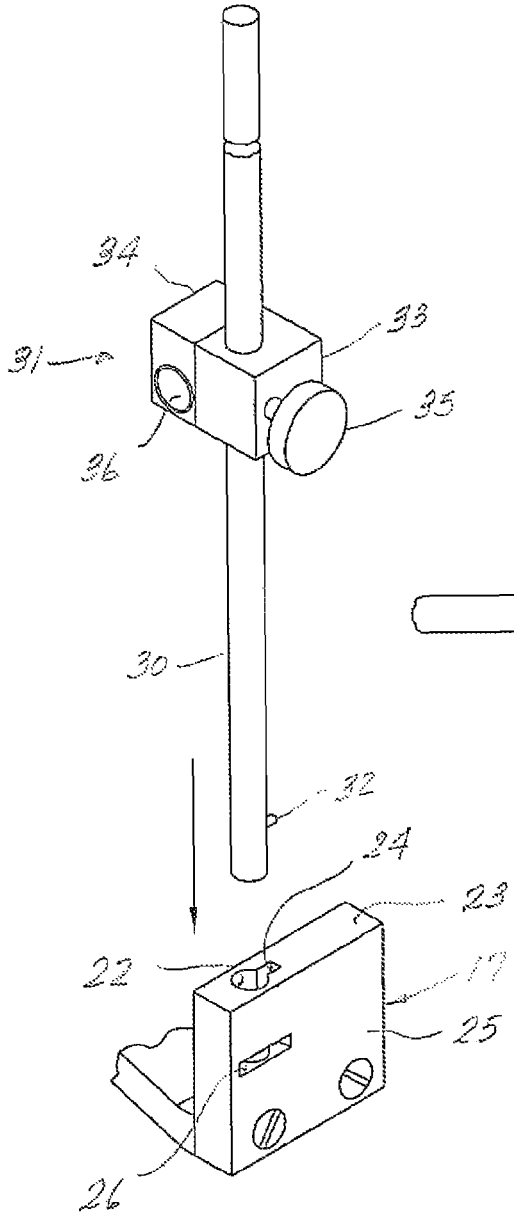
FIG. 6 is a perspective view of a portion of the assembly shown in FIGS. 1 and 2, having a portion of the base member thereof broken away and a post section thereof shown in exploded relation relative to the base member.
Figure 7:
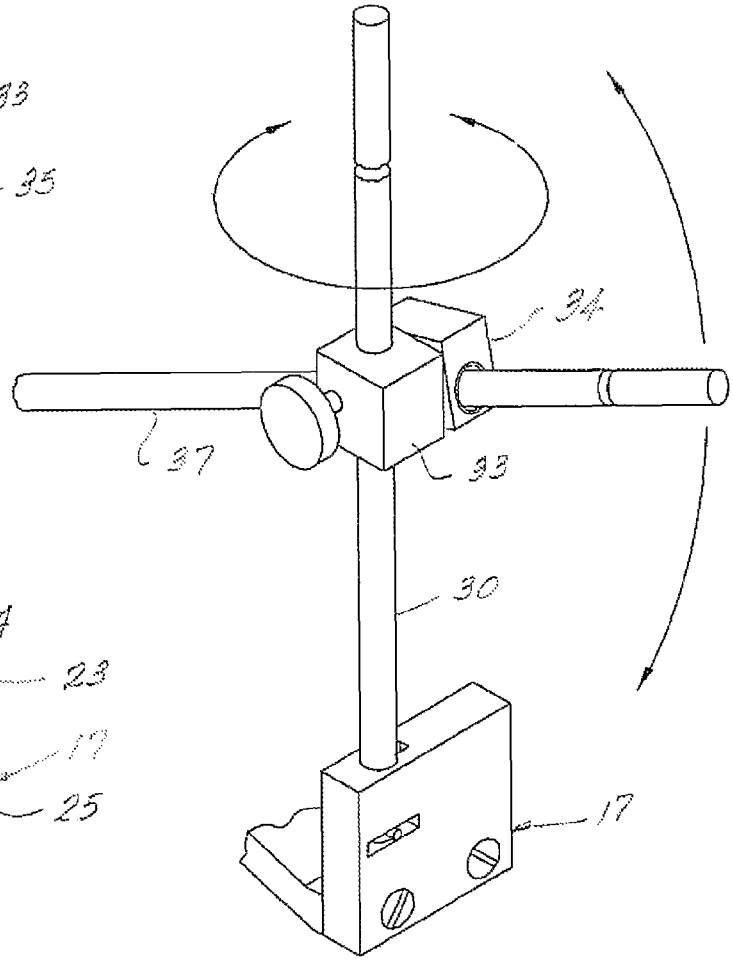
FIG. 7 is a view similar to the view shown in FIG. 6, illustrating the post member thereof mounted in the base member thereof and a portion of the honing tool shown in FIGS. 3 through 5 being supported and guided by a carrier member supported on the post member.

As best shown in FIGS. 6 and 7, upright section 17 of the base member is provided with a substantially vertically disposed bore 22 in an upper surface 23 thereof, which is provided with a slot 24 along the length thereof. Rear surface 25 of such upright section is provided with a recess 26 which communicates with bore 22 and slot 24.

Detachably insertable into bore 22 of upright base section 17 is a post member 30 provided with a carrier assembly 31. The lower end of post member 30 insertable in bore 22 is provided with a substantially radially projecting pin 32 which may be aligned with slot 24 when the lower end of post member 30 is inserted in bore 22. The depth of bore 22 is such so that when the lower end of post member 30 is inserted in bore 22 and seated on the bottom thereof, pin 32 will be aligned with recess 26 to permit the post member to pivot about its axis and angularly displace pin 32 from slot 24 into recess 26 to conclude the axial displacement of the post member, restricted by the engagement of pin 32 with an upper surface of recess 26.

Carrier assembly 31 consists of a block 33 provided with an opening for receiving post member 30 therethrough and allowing block member 33 to be displaced along the length of the post member, and a block 34 swivably mounted on block member 33 and pivotal about an axis disposed radially relative to the axis of post member 30. Block member 33 may be displaced along and positioned at any point along the length of post member 30 by means of a screw 35 threaded through block member 33 and engageable with the surface of post member 30, and further provided with a rounded end portion which may be gripped and turned by the fingers in adjusting the position of the carrier assembly along the length of post member 30. Block member 34 is provided with a bore 36 therethrough which is adapted to receive and freely support a rod section 37 of tool member 11.

Figure 3:
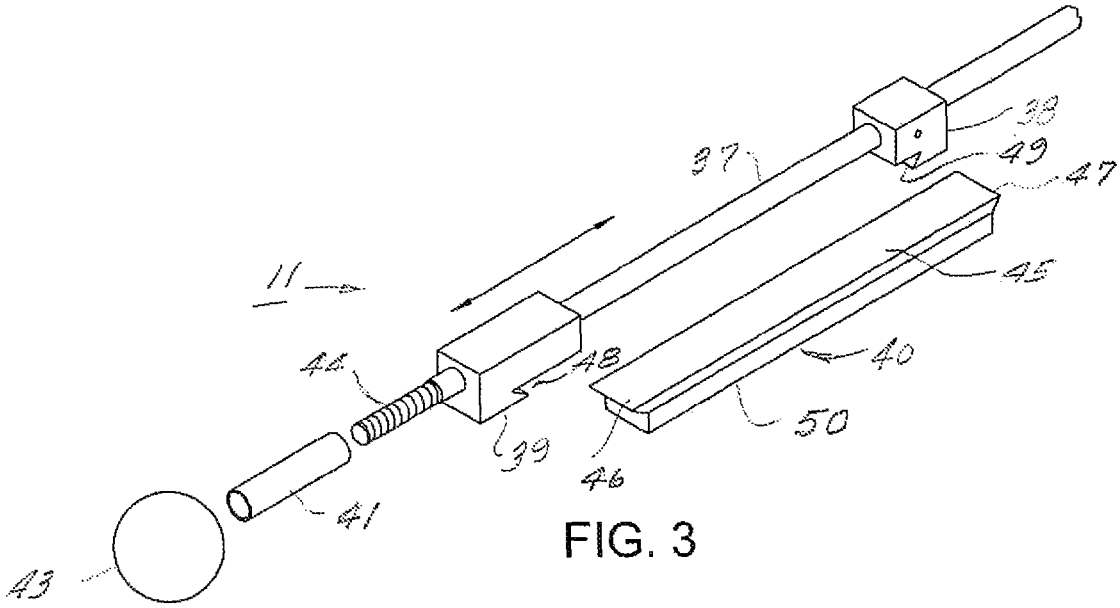
FIG. 3 is a perspective view of the honing tool disclosed in FIGS. 1 and 2, illustrating the components thereof in exploded relations.
Figure 4:
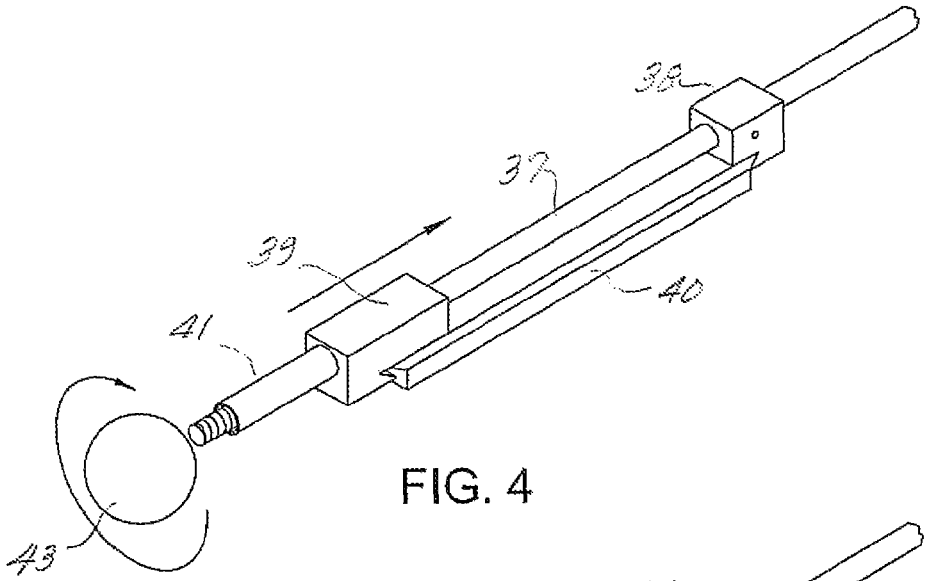
FIG. 4 is a view similar to the view shown in FIG. 3, illustrating the components thereof in assembled condition except for an end knob thereof.
Figure 5:
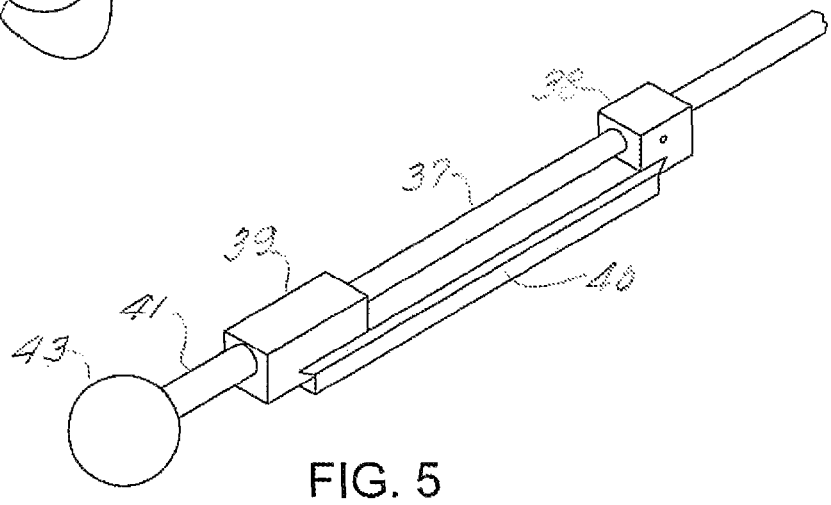
FIG. 5 is a view similar to the view shown in FIG. 4 illustrating the components thereof in fully assembled conditions.

Referring to FIGS. 3 through 5, tool member 11 consist of elongated rod 37, a fixed clamping block 38, a displaceable clamp 39, a honing member 40, a cylindrical sleeve 41 and a knob 43. Fixed clamping member 38 is rigidly secured to rod section 37 at a point spaced from the free end thereof to permit such end to be inserted through bore 36 of swivel block member 34 as shown in FIG. 7. Clamping block member 39 is disposed on rod section 37 adjacent a threaded end portion 44 thereof and is displaceable toward and away from fixed block member 38 to engage and retain honing member 40 between such blocks. Honing member 40 consist of an elongated support section 45 provided with beveled end portions 46 and 47 which are adapted to be received in complimentary opposed beveled recesses 48 and 49 in displaceable and fixed block members 39 and 38 when support section 45 is disposed therebetween, and an elongated honing stone 50 secured to the underside of support section 45.

When honing member 40 is positioned between fixed and displaceable block members 38 and 39 with beveled portions 48 and 49 aligned with recesses 48 and 49, respectively, and displaceable block member 39 is displaced to embrace honing member 40 therebetween, the honing member may be securely positioned on the underside of rod section 37 by means of cylindrical sleeve 41 adapted to be positioned on threaded end portion 44 of the rod section in engagement with displaceable block member 39, and knob 43 having a threaded opening therein which may be threaded onto the end of threaded portion 44 into engagement with the sleeve member to urge displaceable block member 39 toward fixed block member 38 to clamp the honing member between such members.

With the assembly as described in the unassembled condition, it may be assembled for use by swinging front support leg 16 out from under elongated base section 18, positioning the base member on support legs and 16, loosening screw 20 to permit separation of the front ends of base section 18 and clamping member 13, inserting a blade to be sharpened between the forward ends of base section 18 and clamping member 13 with the cutting edge thereof protruding beyond the ends thereof, and then turning screw 21 to angularly displace the front end of the clamping member into clamping relation with the blade. Post member 30 with carrier assembly 31 mounted thereon is then mounted on upright section 17 of the base member by aligning the post member with bore 22 and pin 32 with slot 24, lowering the lower end into bore 22 and then pivoting the post member about its axis to pivot pin 32 into recess 26 thus precluding the withdrawal of the post member unless it is pivoted about its axis. to align pin 32 with slot 24. Screw 35 then may be loosened to position the carrier assembly at a starting height and aligning bore 36 of block member 34 with the edge of the retained blade. The tool member then may be assembled by displacing clamping member 39 away from fixed clamping member 38 to permit honing member 40 to be positioned beneath rod section 37 in alignment with the recesses of the clamping members, and then threading knob 43 onto threaded rod portion 41 to displace clamping member 39 and correspondingly clamp the honing member between the clamping members. With the tool in such assembled condition, the free end thereof may be inserted through bore 36 in block member 34 and the honing member thereof may be positioned on the protruding cutting edge of the retained blade, ready to be reciprocated to sharpen the blade.

As the blade sharpening procedure proceeds, the engaged section of the blade along the edge thereof may be varied and the angle of the cutting edge also may be varied simply by loosening screw 35 of the carrier assembly and displacing the carrier assembly along and about the axis of the post member, and then tightening screw 35 to fix the clamping assembly in the desired position. In adjusting the position of the carrier assembly, the post member is free to rotate about its axis by reason of pin 32 being free to pivot within recess 26 of upright section 37 of the base member.

To disassemble the device, the tool may be removed simply by gripping the knob 43, lifting the tool off of the blade and withdrawing it from bore 36 in the carrier assembly. Then, the post member with carrier assembly secured thereto may be removed from the base member simply by pivoting the post member about its axis so that pin 32 is aligned with slot 24 and lifting the post member out of boar 22. The disassembled components then may be grouped together and inserted into a suitably configured container for storage purposes.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

I claim:

1. A blade sharpening assembly, comprising:

a base member;

a clamping member disposed on said base member, cooperable therewith for releasably securing a blade thereon with a cutting edge thereof protruding thereforrn;

a rod removably insertable in a bore disposed in said base member, said bore has an elongated recess along a length thereof and a transversely disposed recess communicating with said elongated slot at a base thereof in said base member, and said rod is provided with a radially protruding pin relative to an axis thereof disposable in said elongated slot and angularly displaceable when positioned in alignment with said transversely disposed recess, permitting said rod to be axially inserted into and removed from said bore with said pin displaced along said elongated slot, and be rotated about its axis when said pin is disposed in alignment with said transversely disposed recess;

a carrier member mounted on said rod, displaceable along a length thereof, including means for releasably securing said carrier member at selected positions along the length of said rod; and a tool for sharpening a blade secured between said base and clamping members, including a handle section, an elongated section engageable with a support surface of said carrier member and a honing section engageable with a cutting edge of a blade secured between said base and clamping members when said elongated section engages said support surface of said carrier member.

2. The assembly according to claim 1 wherein said base member includes an elongated section which cooperates with said clamping member to secure said blade, and a support leg section pivotally connected on an underside of said elongated section and pivotal between a stored position on said underside and an extended position to support said elongated section at an angle with a front end thereof elevated.

3. The assembly according to claim 2 wherein said base member includes an upright section spaced from said front end thereof.

4. The assembly according to claim 1 wherein said clamping member is provided with means cooperating with said base member providing a fulcrum, and means cooperable with said base member operable to angularly displace said clamping member about said fulcrum to engage said blade in clamping and unclamping relation.

5. The assembly according to claim 1 wherein said carrier member comprises a block provided with an opening therethrough which receives said rod, and includes means for releasably securing said block to said rod at selected positions therealong.

6. The assembly according to claim 5 wherein said block securing means comprises a member threaded through said block and engageable with said rod.

7. The assembly according to claim 5 wherein said carrier member is provided with a member swivably connected to said block, providing said support surface for said elongated section of said tool.

8. The assembly according to claim 7 wherein said member swivably connected to said block comprises a block having an opening therethrough for receiving a portion of said elongated section of said tool, provided with said support surface.

9. The assembly according to claim 1 wherein said elongated section of said tool includes a first retaining member fixed thereto and a second retaining member displaceable along the length thereof and cooperate with said fixed retaining member to grip said honing section therebetween.

10. The assembly according to claim 9 including means for releasably securing said displaceable retaining member into pressing engagement with said honing section disposed between said retaining member.

11. The assembly according to claim 10 wherein said retaining members include opposed recesses functional to receive end portions of said honing section therein.

12. The assembly according to claim 11 wherein each end of said honing section and a cooperating recess in a retaining member are provided with an angle-shaped configuration.

13. A blade retaining and a honing tool guide assembly, comprising:

a base member;

a clamping member disposed on and cooperable with said base member for releasably retaining a blade on said base member with a cutting edge of said blade protruding from said base and clamping members;

a rod mountable on said base member; and a carrier member mounted on said rod, displaceable along a length thereof, including means for releasably securing said carrier member at selected positions along the length of said rod, and means for supporting a section of a tool having a honing section engage able with the cutting edge of a blade gripped between said base and clamping members.

14. The assembly according to claim 13 wherein said rod is removably insertable in a bore disposed in said base member, said bore has an elongated slot along a length thereof and a transversely disposed recess communicating with said elongated slot at a base thereof in said base member, and said rod is provided with a radially protruding pin section relative to the axis thereof disposable in and along said elongated slot and angularly displaceable when positioned in alignment with said transversely disposed recess, permitting said rod to be axially inserted into and removed from said bore with said pin displaced along said elongated slot, and be rotated about its axis when said pin is disposed in alignment with said transversely disposed recess.

15. The assembly according to claim 13 wherein said carrier member comprises a block provided with an opening which receives said rod therethrough and includes means for releasably securing said block to said rod at selected position therealong.

16. The assembly according to claim 15 wherein said block securing means comprises a member threaded through said block and engage able with said rod.

17. The assembly according to claim 15 wherein said carrier member is provided with a member swivably connected to said block, providing a support surface for said tool section.

18. The assembly according to claim 17 wherein said member swivably connected to said block comprises a block having an opening therethrough for receiving a portion of tool section, provided with said support surface.

* * * * *